United States Patent [19]

Garcia

[11] Patent Number: 4,815,390

[45] Date of Patent: Mar. 28, 1989

[54] MORTAR CARRIER PROJECTILE

[75] Inventor: Jose G. Garcia, Vizcaya, Spain

[73] Assignee: Esperanza y Cia, S.A., Spain

[21] Appl. No.: 57,311

[22] Filed: Jun. 4, 1987

[30] Foreign Application Priority Data

Aug. 8, 1986 [ES] Spain ..... 8600962

[51] Int. Cl.[4] ..... F42B 13/50

[52] U.S. Cl. ..... 102/489; 102/357; 102/393

[58] Field of Search ..... 102/342, 343, 351, 357, 102/393, 445, 489, 491, 494, 496, 497, 505

[56] References Cited

U.S. PATENT DOCUMENTS

| | | | |
|---|---|---|---|
| 1,366,555 | 1/1921 | Brayton | 102/342 |
| 2,476,973 | 7/1949 | Gillon . | |
| 2,786,415 | 3/1957 | Alderson . | |
| 3,016,011 | 1/1962 | Brown . | |
| 3,181,465 | 5/1965 | Anthony . | |
| 4,119,037 | 10/1978 | Romer et al. . | |
| 4,218,976 | 8/1980 | Luebbers . | |
| 4,488,489 | 12/1984 | Schoffl | 102/489 |
| 4,524,694 | 6/1985 | Boeder | 102/393 |
| 4,549,487 | 10/1985 | Jensen | 102/498 |
| 4,651,048 | 3/1987 | Alon | 102/357 |

FOREIGN PATENT DOCUMENTS

| | | | |
|---|---|---|---|
| 3506889 | 8/1980 | Fed. Rep. of Germany | 102/489 |

*Primary Examiner*—Stephen C. Bentley
*Assistant Examiner*—Richard Klein
*Attorney, Agent, or Firm*—Lucas & Just

[57] ABSTRACT

A mortar carrier projectile that is characterized for its having a front body with a front head carrying a fuze, and a cylindrical rear body carrying the charge; a rear body of approximately a tapered head shape; a stabilizing tail joined to the rear body, and linking means between the front body and the rear body which fracture by shearing.

8 Claims, 4 Drawing Sheets

MORTAR CARRIER PROJECTILE

The need to fulfil varying missions with mortar type weapons has led to the creation of a high capacity single cylindrical body kind of projectile to take differing charges and thus obviate the need to employ alternative projectiles, with the ensuing disadvantage of having to diversify the fabrication and the use different range tables and packing for each one of same.

This invention is a mortar carrier projectile that is characterized because it is comprised of:

(a) a front body having a forward head that carries a fuze, and a cylindrical rear section carrying the charge;

(b) a rear body whose shape is approximately that of a tapered head;

(c) a stabilizer tail attached to said rear body;

(d) means of attachment between said front body and said rear body.

It is moreover characterized because said means of attachment between the front and rear bodies fracture by shearing.

It is furthermore characterized because it possesses a seal ring located at the commencement of the maximum diameter area on the projectile.

It is also characterized because the fuze detonates an ejection cartridge which fractures the shear members.

It is also characterized because the charge is in the form of a package located between a front closure and a rear seating piece.

It is also characterized because the charge is an assembly of sub-shell rows, where rear protrusions belonging to the last row of such sub-shells are inserted into recesses in said rear seating piece.

It is also characterized because said rear seating piece is a wholly inside part of the shell, or it is comprised of an intermediate joining piece between the front body and the rear body in the form of appropriate shear pins.

It is also characterized because tensile rods are joined to the head and possess a critical area at their rearmost end in order to shear at the join with rear seating piece area.

It is also characterized because in the stock there is provided an ejector for the purpose of removing therefrom said last row of sub-shells through their being thrusted by the linking protrusion.

It is also characterized because the action of the ejector mechanism in the stock is initiated when the subshell package tensile rods shear.

It is also characterized because helical springs are provided on the pressure rods for the purpose of separating the sub-shell rows once ejection has taken place.

It is also characterized because a retarder is fitted between the charge and the ejection cartridge.

It is also characterized because the front closure and the rear seating piece are linked to one another by means of tensile rods and held apart by pressure rods.

Figure 1:
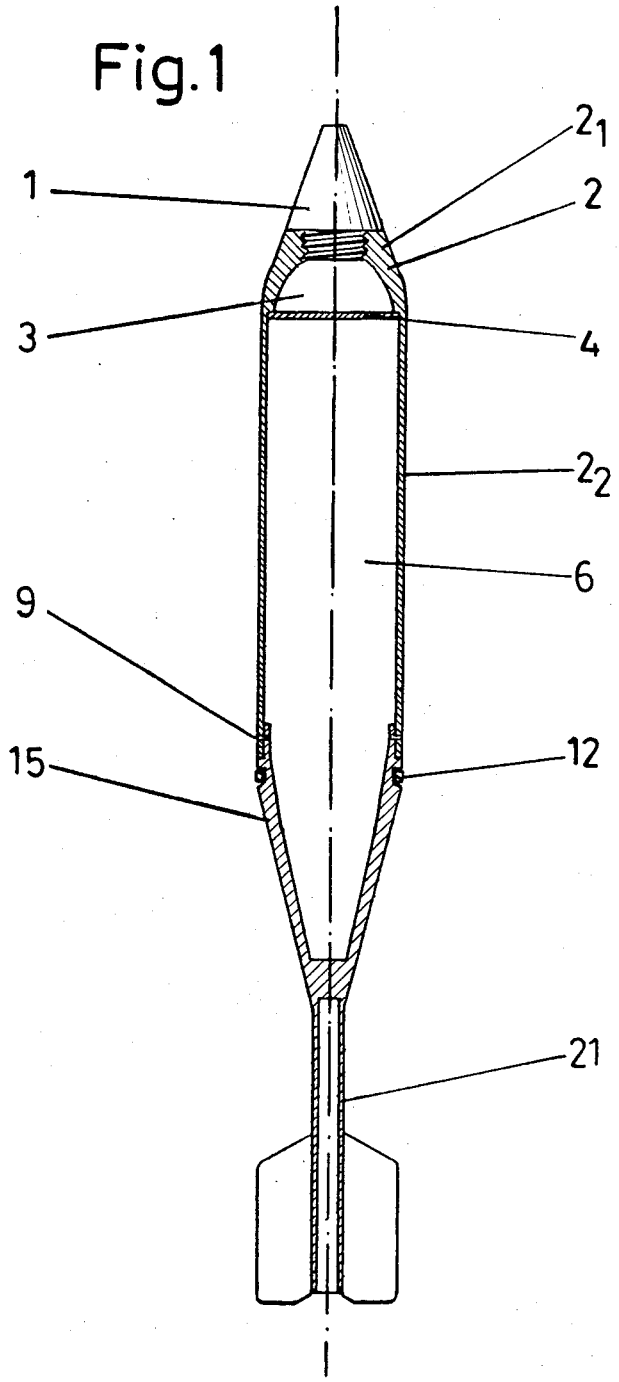
FIG. 1 is a diagrammatic cross-section elevational view of the projectile with a powerful destructive charge.

The projectile is comprised of a front body (2) constructed in one or two parts with a front section ($2_1$) and a cylindrical rear section ($2_2$), together with a straight tapered or convex-concave rear stock (15) formed by one or two pieces attached to the stabilizer tail (21).

Time fuze (1) is attached to the front section ($2_1$), while both front body (2) and rear stock (15) are linked together by shear pins (9).

The middle section takes the working charge (6) of whatever composition is required for the particular purpose, while at the commencement of the maximum diameter of the tapered rear stock (15) is located the seal ring (12).

A disc shaped steel closure (4) located beneath the front section ($2_1$) (between the cylindrical section and the head) segregates and divides the front body (2) into two compartments.

Shells of this kind (FIG. 1) can fulfil the mission of doing extensive destruction to buildings and constructions due to their carrying a large amount of high explosive.

The design of such shell is shown in FIG. 1, and here closure (4) depicted therein may as an alternative be omitted and an instantaneous or time delay percussion fuze employed instead.

The joint between front body (2) and rear stock (15) is required to be gastight, and pins (9) may be replaced by a threaded connection.

Operation is as normal for an H.E. shell with instantaneous-delayed fuze.

Figure 2:
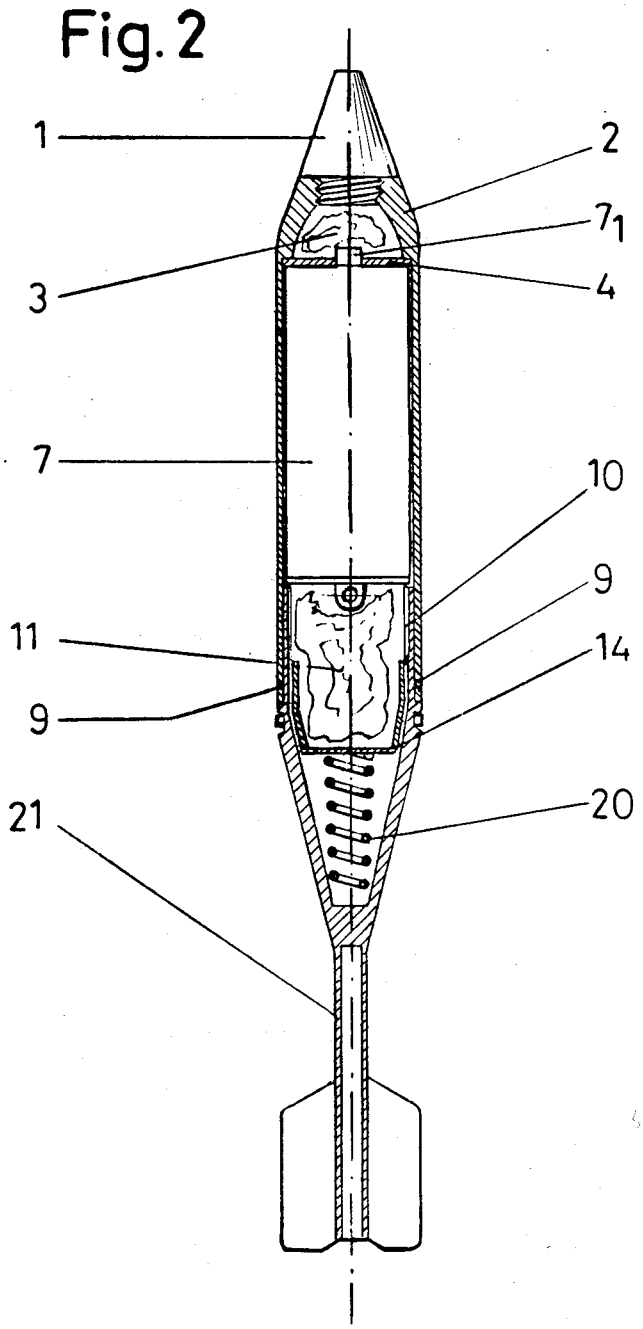
FIG. 2 is a diagrammatic cross-section elevational view with a powerful long-lasting illumination charge.

FIG. 2 depicts the shell with a high power illumination charge.

The purpose of shells of this type is to provide extensive illumination over the ground characterized by illuminative power and duration which are much greater than those of an ordinary illuminant.

From FIG. 2, it may be seen that the working charge (6) inserted within the shell illustrated in FIG. 1 consists of a flare (7), its parachute (11), the thruster sectors (10) which may be comprised of cylinder sectors, the seat (14), and the ejector spring (20), and here the fuze (1) is a time fuze.

Seat (14) may in turn comprise several parts to facilitate the emergence and unfolding of the parachute (11).

Operation is as follows:

When the fuze (1) time delay setting has elapsed after the shell is fired, the fuze detonates cartridge (3) which on the one hand will ignite the fuze on the flare (7) time delay ($7_1$), and on the other will exert pressure upon the closure (4), the flare (7) and sectors (10) thus causing pins (9) to shear whereupon the fuze (1) and body (2) will be propelled forwards, and the remainder is propelled rearwards.

Spring (20), which exerts pressure upon the sectioned seat (14), causes the detachment of the flare (7) and parachute (11) unit.

Figure 3:
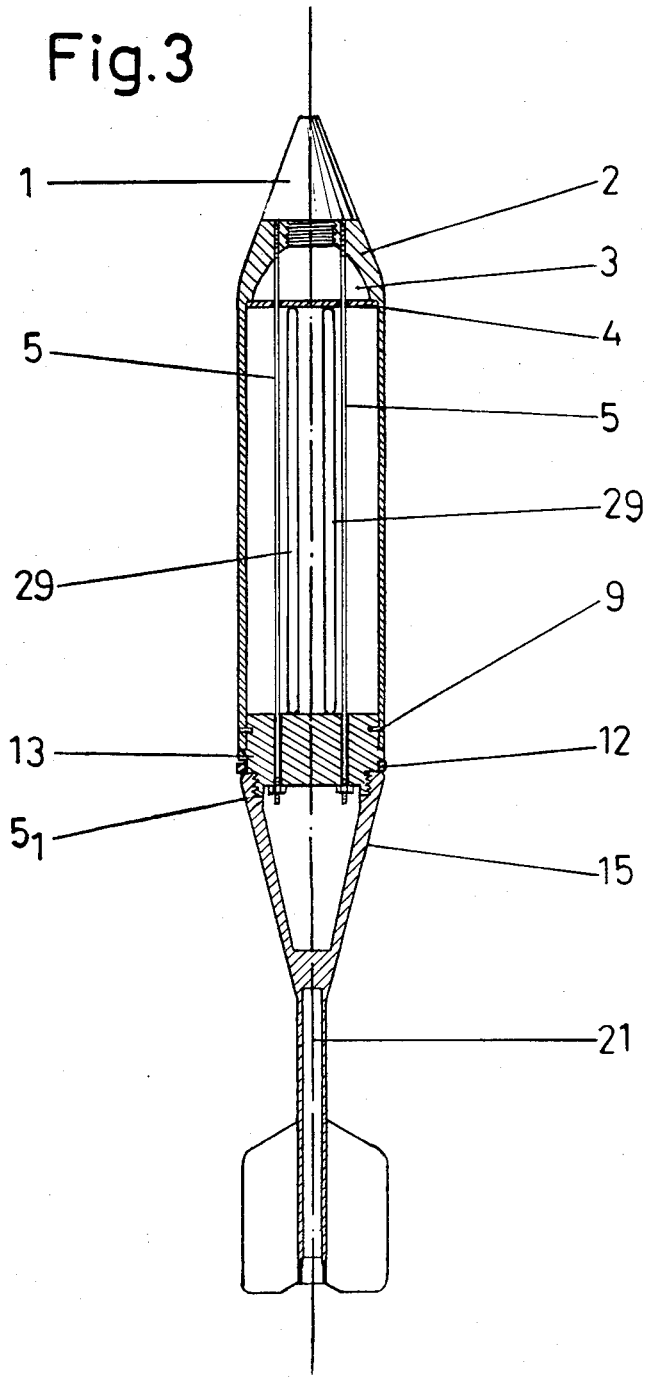
FIGS. 3 and 4 depict cross-section elevational and diagrammatic views of the projectile with a multi-shell charge.
Figure 4:
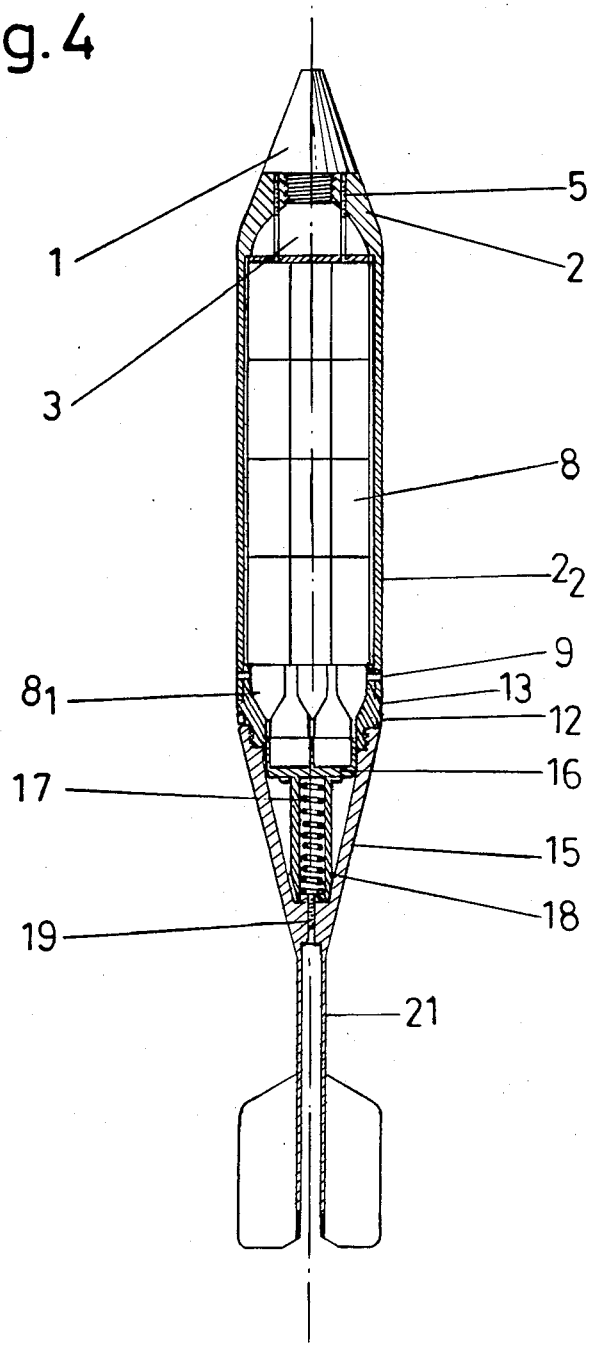

FIGS. 3 and 4 depict the anti-tank/anti-personnel multi-shell projectile.

This kind of shell, which today is commonly used among armed forces and is the-basic purpose of this patent, is designed to shower the enemy with charges of any one among various types such as incendiary, anti-personnel, anti-tank, mines, and suchlike, with the combined anti-personnel/anti-tank version being the most widely employed today.

In order to adapt these types of sub-shells to the carrier shell, and also for the purposes of handling and loading them, it is necessary to arrange such sub-shells in the form of packages, and to insert and attach each such package to the carrier shell.

The package (FIG. 1) comprising the charge (6) is formed in this instance by two end pieces, one being the closure (4) and the other the seating piece (13) (FIG. 3), these being held apart from one another by pressure rods (29) and held together by tensile rods (5) which run through the front closure (4) and are screw attached to the head (2).

Cylindrical or polygon shaped sub-shells (8) are interlocked to form rows, the end protrusion ($8_1$) on the last of which is inserted into the seating piece (13) which is required to withstand the inertia from all such rows. The cross section view of the shell is thus as depicted in FIG. 4, and it must be realized that tensile and pressure rods (5) and (29) occupy spaces between the rows of sub-shells.

The rear or the stock (15) of the shell houses in the construction illustrated here, the row ejection mechanism, whose purpose is to eject the final sub-shell from each row on the seating piece (13). (FIG. 3).

Such ejection is accomplished through the action of a spring (17) housed inside a casing (18) attached to the stock (15) by means of screwed stud (19).

The front of said casing (18) is joined to the ejection member (16) by the ends ($5_1$) of tensile rods (5), which have to shear at such ends ($5_1$) in order for such ejection member (16) to come into action.

As may be seen by examining FIGS. 3 and 4, said seating piece (13) which embodies housings for end protrusions ($8_1$) on sub-shells (8) in each row, is the component which carries the seal ring (12), and it is thread attached to the rear stock (15). It acts in turn as the seat for the cylindrical section ($2_2$) belonging to front body (2), and houses the ends of shear pins (9), but this arrangement has been illustrated in FIGS. 3 and 4 to show a different version of the assembly to that depicted in FIGS. 1 and 2, because said seating piece (13) may be located internally on the arrangement illustrated in FIGS. 1 and 2 in the form of a disc with housings which is supported upon the front edge of the rear stock (15) (although with the same outside profile, this arrangement would provide a smaller charge capacity).

Operation is as follows:

After firing a shell fitted with a time fuze, then once the time set on the time setting has elapsed, the fuze (1) will detonate ejection cartridge (3) which will thrust closure (4) rearwards.

Said closure (4) thereupon thrusts the package of sub-shells (8) and pusher rods (29) which, upon thrusting in turn against seating piece (13), will on the one hand cause pins (9) to shear, and on the other will shear tensile rods (5) at their rearmost end, and since said tensile rods are attached to head (2), the effect will be for the closure (4) to be ejected rearwards together with compression rods (29), seating piece (13), stock (15), and tail (21).

Immediately thereafter, when casing (18) is released from ejection member (16) due to the ends of tensile rods (5) being fractured, the force exerted upon said ejection member (16) by spring (17) will shift the protrusions of the last row of sub-shells, thus allowing said sub-shells, pusher rods (29) and closure (4) to fall away freely from the rear of the shell, the seating piece (13), the stock (15), the tail (21) and the ejection member, which will all drop down in one piece.

I claim:

1. A mortar shell for carrying multiple charges comprising:

(a) a front hollow body;

(b) a disc shaped closure positioned in said front hollow body and dividing said front hollow body into a forward, conical head section and a rearward, cylindrical back section;

(c) a rear body, said rear body having a shape similar to said forward, conical head section;

(d) a stabilizer tail section, said stabilizer tail section having a forward cylindrical neck section attached to said rear body and a rearward fin section;

(e) a hollow seating member, said seating member attached at one end to said rear body;

(f) a shear pin attaching said rearward, cylindrical back section of said front hollow body to another end of said hollow seating member;

(g) a fuse carried in a forward portion of said forward, conical head section of said front body;

(h) an ejector cartridge carried in a rear portion of said forward, conical head section of said front body;

(i) a charge comprising an assembly of sub-shell rows positioned in said rearward, cylindrical back section of said front hollow body and extending from said disc shaped closure to said hollow seating member.

2. The mortar shell of claim 1 wherein said hollow seating member is positioned partially inside of the shell.

3. The mortar shell of claim 2 further comprising tensile rods which extend inside said shell from said forward, conical head section to said rear body, said tensile rods possessing a critical area at said tensile rods rearmost end in order to shear at the join with the hollow seating member area.

4. The mortar shell of claim 3 further comprising an ejector mechanism for removing that portion of said sub-shells positioned in said hollow seating member.

5. The mortar shell of claim 4 wherein the action of the ejector mechanism is initiated when the tensile rods shear.

6. The mortar shell of claim 5 further comprising pressure rods positioned in said shell and extending from said disc shaped closure to said rear body, said pressure rods for separating the sub-shell rows once ejection has taken place.

7. The mortar shell of claim 6 further comprising a retarder fitted between the charge and the ejector mechanism.

8. The mortar shell of claim 1 wherein the disc shaped closure and the hollow seating member are linked to one another by means of tensile rods and held apart by pressure rods.

* * * * *